United States Patent [19]

Lindroos

[11] 4,245,983

[45] Jan. 20, 1981

[54] SCREW CONVEYOR FOR FEEDING LIME SLUDGE OR CEMENT TO A LIME AND CEMENT KILN, RESPECTIVELY

[76] Inventor: Runar I. Lindroos, 22 Granstigen, Frövi, Sweden

[21] Appl. No.: 73,131

[22] Filed: Sep. 6, 1979

[30] Foreign Application Priority Data

Sep. 11, 1978 [SE] Sweden ..... 7809537

[51] Int. Cl.[3] ..... F27D 3/00; F27B 7/38; F27B 7/32

[52] U.S. Cl. ..... 432/235; 110/246; 414/158; 432/116; 432/117

[58] Field of Search ..... 414/158; 110/246; 432/103, 116, 117, 139, 233, 239, 235

[56] References Cited

U.S. PATENT DOCUMENTS

| | | | |
|---|---|---|---|
| 1,782,423 | 11/1930 | Hornsey | 432/235 |
| 1,787,841 | 1/1931 | Schulze | 432/235 |
| 1,993,688 | 3/1935 | Specketer et al. | 432/235 |
| 2,043,459 | 6/1936 | Windecker | 110/246 |

*Primary Examiner*—John J. Camby

*Attorney, Agent, or Firm*—Burns, Doane, Swecker & Mathis

[57] ABSTRACT

The invention relates to a feed conveyor for lime sludge to a lime kiln and, respectively, of cement to a cement kiln. The conveyor, which has the form of a screw conveyor, is characterized in that its housing is cooled by a cooling liquid so that a condensate film is formed on the inside of the housing.

8 Claims, 2 Drawing Figures

SCREW CONVEYOR FOR FEEDING LIME SLUDGE OR CEMENT TO A LIME AND CEMENT KILN, RESPECTIVELY

This invention relates to a screw conveyor for feeding lime sludge or cement to a lime kiln and cement kiln, respectively, in the form of an inclined rotary kiln.

Lime sludge burning, for example, is carried out industrially in a rotary kiln, which has the form of a long, slightly inclined cylinder rotating through about one revolution per minute. At the lower end of the kiln an oil burner is mounted, and at its upper end the kiln is provided with a feed device in the form of a screw conveyor charging the kiln with the lime sludge. At the lower end of the kiln where the lime drops out, the temperature is about 1150° C.

For rendering the burning process profitable, the lime sludge charge must be as dry as possible and have a dry content of 55–80% when it is being fed into the kiln.

At present, lime sludge burning involves great problems, due to the fact that the lime sludge at the prevailing high temperature has the tendency of rapidly sintering and accumulating on the inside of the screw conveyor and on the peripheral portions of the screw. As a consequence thereof, the screw moves increasingly slower (implying a higher power demand), and the feed conveyor must be exchanged and cleaned at regular intervals.

The situation is in principle the same also at the cement manufacturing process.

In many cases drive motors with higher power are installed in order to lengthen the operation periods, but this involves the risk of wrenching the screw defective. As an example it can be mentioned that in some cases motors of up to about 80 HP have been installed for driving the screw. Experiments have been made, too, to reduce the dry content of the lime sludge which, however, had to be compensated for by a higher combustion temperature and, thus, a higher oil consumption, which brings about a sharp profitability drop.

These problems have been solved in a very simple and genial way by the present invention, in that it has been given the characterizing features defined in the attached claims. It is hereby possible to maintain a high dry content of the lime sludge or cement and at the same time to keep a low drive power for the conveyor screw. For a corresponding conveyor using an 80 HP motor, a motor of only 10 HP is required when the present invention is being utilized.

Figure 1:
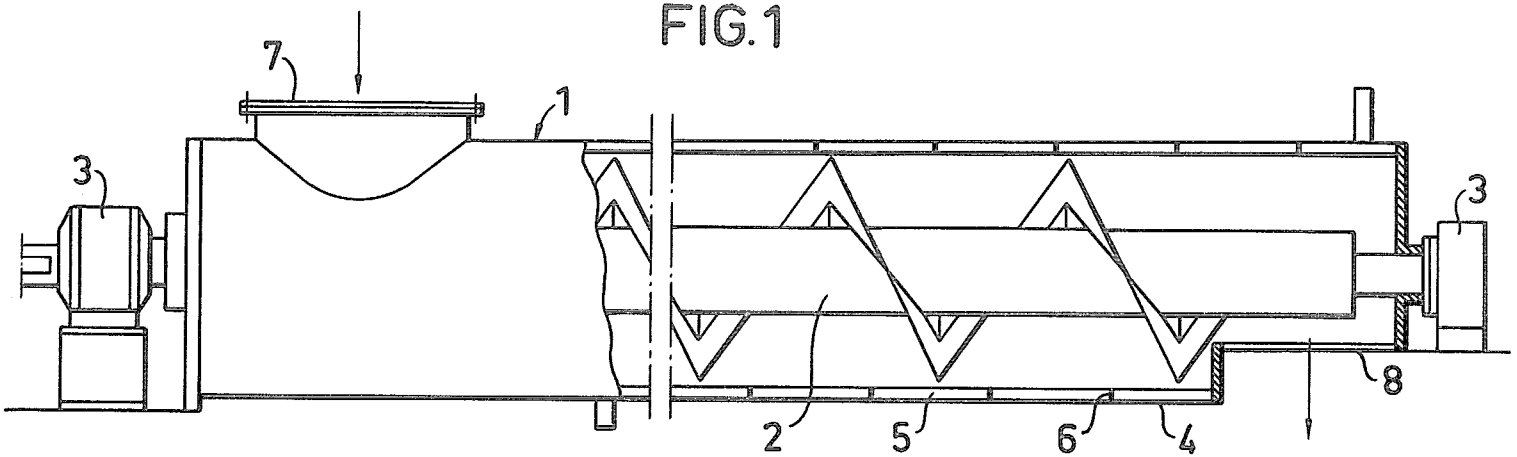
Figure 2:
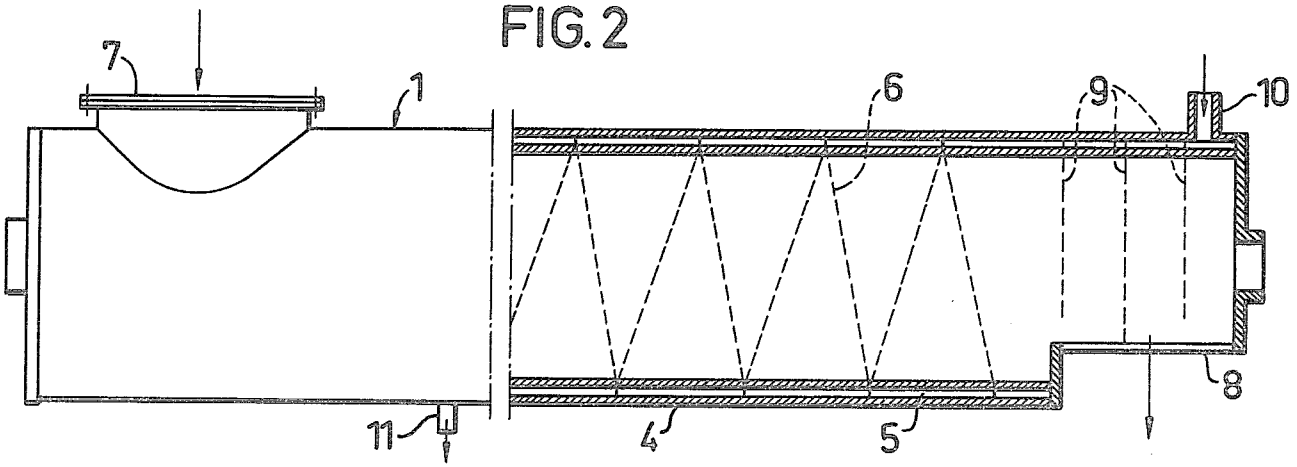

The invention is described in greater detail in the following by way of an embodiment, with reference to the accompanying drawing, in which FIG. 1 is a section of a screw conveyor where also the screw is shown, and FIG. 2 is a section only of the conveyor housing.

The conveyor comprises a housing 1 and a screw 2 rotatably mounted therein. The screw is supported in bearings 3 (schematically indicated), which are attached to an outside foundation (not shown). The screw is driven in conventional manner by a motor (not shown). The housing 1 proper is enclosed by a shell 4 so that a space 5 is formed between the housing and the shell. Said space, of annular section, is divided by a partition wall 6 extending helically about the housing (see FIG. 2). The conveyor further is provided with an opening 7 for charging, and an opening 8 for discharging the lime sludge and cement, respectively. Due to the opening 8, the partition wall here cannot extend continuoulsy, but instead is designed as a labyrinth with walls 9 alternatingly extending to opposite edges of the opening 8. The inlet for cooling water is located at 10, and the outlet at 11, so that the cooling water has a flow countercurrent to the lime sludge.

The cooling can be effected according to demand along a greater os shorter length of the conveyor, as indicated in the Figures, in that the partition wall is drawn to extend with different distance to the charge opening.

The object of cooling the housing is not to cool the conveyor because of overheating therein and in its bearings, nor to lower the temperature of the lime sludge or cement being fed through the conveyor, which would require different operation conditions with respect to heat supplied from the oil burner, but the object is only to cool the conveyor housing to such a degree that on the inside of the housing a film of condensate is formed. This condensate has proved to act as a "lubricant film" between the housing and the lime sludge or cement, which efficiently prevents any sintering tendency at the housing. This in turn means that neither the lime sludge nor the cement has the tendency of adhering to the screw in the previous disadvantageous manner, because it is not braked as has been the case conventionally. A temperature of the cooling water of about 20° C. is sufficient.

What I claim is:

1. A screw conveyor in combination with a kiln, said screw conveyor arranged to feed material to an inlet of said kiln to be heated therein, said screw conveyor comprising a helical screw enclosed by a cylindrical housing such that the material travels along an inner surface of said housing, a cylindrical shell enclosing said housing and spaced outwardly from an outer cylindrical surface thereof to form a space therebetween, and means for introducing a cooling liquid into said space in contact with said outer surface of said housing to directly cool said housing and form a film of condensate on said inside surface of said housing and resist sintering of the material thereon.

2. Apparatus according to claim 1, wherein a partition wall is disposed within said space and extends helically therealong, a liquid inlet and outlet disposed at opposite ends of said shell.

3. Apparatus according to claim 2, wherein said inlet is disposed at a discharge end of said conveyor, and said outlet located at a charging end thereof; said cooling liquid being at room temperature.

4. Apparatus according to claim 1, wherein said kiln is an inclined rotary cement kiln and said material is cement.

5. Apparatus according to claim 1, wherein said kiln is an inclined rotary lime sludge kiln and said material is lime sludge.

6. A screw conveyor adapted for use with a kiln to feed material to an inlet thereof, said screw conveyor comprising a helical screw enclosed by a cylindrical housing such that the material travels along an inner surface of said housing, a cylindrical shell enclosing said housing and spaced outwardly from an outer cylindrical surface thereof to form a space therebetween, and means for introducing a cooling liquid into said space in contact with said outer surface of said housing to directly cool said housing and form a film of condensate on said inside surface of said housing and resist sintering of the material thereon.

7. Apparatus according to claim 6, wherein a partition wall is disposed within said space and extends helically therealong, a liquid inlet and outlet disposed at opposite ends of said shell.

8. Apparatus according to claim 7, wherein said inlet is disposed at a discharge end of said conveyor, and said outlet located at a charging end thereof; said cooling liquid being at room temperature.

* * * * *